United States Patent [19]

Christian

[11] 4,402,504

[45] Sep. 6, 1983

[54] WALL MOUNTED ADJUSTABLE EXERCISE DEVICE

[76] Inventor: Robert J. Christian, 3500 Hillcrest Dr., Waco, Tex. 76708

[21] Appl. No.: 265,184

[22] Filed: May 19, 1981

[51] Int. Cl.[3] ..... A63B 21/06

[52] U.S. Cl. ..... 272/118; 272/136; 272/142; 272/DIG. 4

[58] Field of Search ..... 272/118, 136, 142, 140, 272/143, 130, 117, DIG. 4

[56] References Cited

U.S. PATENT DOCUMENTS

| | | | |
|---|---|---|---|
| 723,625 | 3/1903 | Thornley | 272/118 |
| 763,475 | 6/1904 | Frazee . | |
| 2,977,120 | 3/1961 | Morris | 272/118 |
| 3,162,441 | 12/1964 | Karlik . | |
| 3,438,627 | 4/1969 | La Lanne | 272/118 |
| 3,815,903 | 6/1974 | Blomqvist | 272/118 |
| 4,072,309 | 2/1978 | Wilson | 272/136 |

FOREIGN PATENT DOCUMENTS 377585 5/1907 France .

*Primary Examiner*—Richard C. Pinkham
*Assistant Examiner*—William R. Browne
*Attorney, Agent, or Firm*—Schuyler, Banner, Birch, McKie and Beckett

[57] ABSTRACT

A multiple purpose wall mounted adjustable exercise device has an upstanding elongated frame including two upright spaced parallel guide posts and an upper pulley and a lower pulley attached to the upper and lower portions of the frame, respectively. A resistance means operatively connected to the frame provides an exercising force in response to exercising motions of the user. A two-ended cable is trained around the upper and lower pulleys with its ends connected to the resistance means. A grip slidably attached to an intermediate portion of the cable is trained around and between two guide pulleys attached to a carriage that is carried by the frame. Guide pulleys guide the intermediate portion of the cable laterally outwardly from the carriage to provide a working loop for engagement by the grip. The height of the carriage is selectively adjustable relative to the frame. The length of the working loop remains substantially constant when not pulled, regardless of the height of the carriage. The resistance means may comprise resiliant elastic straps, coiled springs or weights.

18 Claims, 10 Drawing Figures

WALL MOUNTED ADJUSTABLE EXERCISE DEVICE

BACKGROUND OF THE INVENTION

I. Field of the Invention

The present invention relates to a vertically oriented wall mounted adjustable exercise device. The device permits a person to exercise against a resistance force supplied by springs, elastic straps, weights, and the like by applying a pulling force to a handle whose height is selectively adjustable.

II. Description of the Prior Art

Compact wall mounted exercise devices employing ropes and pulleys are well known to those skilled in the art. Such systems are described in, for example, U.S. Pat. No. 763,475, which employs a resistance such as a coiled spring. By exerting a force against a handle, the user exercises against the known resistance. Devices of this type generally do not permit easy substitution of resistance elements having different spring rates. In addition, the height of the handle changes according to the direction of the force exerted by the user, so that it is difficult to exert an exercising force at a constant desired angle.

Exercising devices were designed to overcome these difficulties with the prior art. These devices typically employ a load, such as a weight, a flexible element such as a rope or cable attached to the weight, a number of pulleys over which the rope or cable runs and a grip or handle at the free end of the cable. When a pulling force in any direction is exerted on the grip, the force exerted on the free end of the cable is transformed into a vertical lifting force, which is applied to the resistance load. Such devices permit adjustment of the height of the grip to suit the exercise to be performed. Devices of this type, however, suffer from the drawback that the free length of the cable projecting from the device varies as a function of the height to which the pulley is adjusted. This undesirably requires a much larger exercise area than would otherwise be necessary.

Some weight lifting exercising devices, permit the user to eliminate the undesirable cable slack caused by adjusting the height of the grip. Such a device is shown in, for example, U.S. Pat. No. 3,815,903. This device requires that a separate adjustment be made in an adjustment pulley to take up unnecessary slack in the cable. This requires two height adjustable pulleys which increases the size, expense and complexity of the device and makes it less convenient to use.

A significant need therefore exists for a compact wall mounted height adjustable exercise device which is adapted for flexible uses and resistance loads, is easy to use, and requires a minimum of adjustment.

SUMMARY OF THE INVENTION

Accordingly, it is an object of the present invention to provide a wall mounted adjustable exercise device that is compact, has minimal depth, and requires minimal area for exercise.

Another object of the present invention is to provide a wall mounted adjustable exercise device having a grip whose height is readily adjustable to meet the needs of any individual exerciser in performing different exercises.

Another object of the present invention is to provide a wall mounted adjustable exercise device which provides a constant length working loop of cable for attachment of the grip, regardless of the height adjustment of the grip.

Another object of the present invention is to provide a wall mounted adjustable exercise device which is easily capable of using different types of resistance means, such as elastic straps, springs, or weights.

Another object of the present invention is to provide such a device wherein the resistance load may be readily varied to meet the exercise needs of the user, whether the resistance means employed includes elastic straps, springs, or weights.

Another object of the present invention is to provide a wall mounted adjustable exercise device that is relatively easy and simple to manufacture and may be made from a variety of readily available materials.

These and other objects are achieved by providing an exercise device comprising an upstanding elongated frame; a resistance means operatively connected to the frame for providing an exercising force in response to exercising motions of a user; an upper pulley attached to the upper portion of the frame; a lower pulley attached to the lower portion of the frame; a two-ended cable trained around the upper and lower pulleys with its ends connected to the resistance means; a grip means slidably attached to an intermediate portion of the cable for engagement by a user to apply pulling exercising motions to the resistance means through the cable; and guide means carried by the frame and selectively positionable at various heights relative to the frame for guiding the intermediate portion of the cable laterally outwardly of the frame so that the length of the outwardly projecting intermediate cable portion, when not pulled, is substantially constant irrespective of the height of the guide means.

The invention may be best understood by referring to the following detailed description and accompanying drawings which illustrate the invention.

DETAILED DESCRIPTION OF THE PREFERRED EMBODIMENTS

Figure 1:
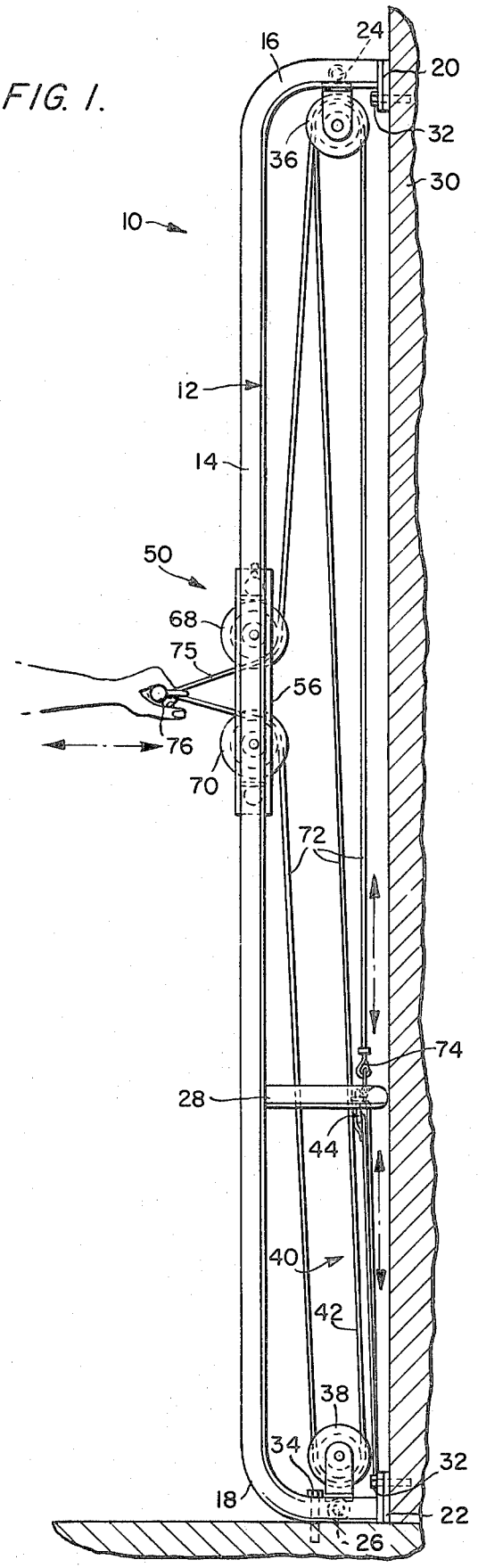
FIG. 1 is a side elevational view of a wall mounted adjustable exercise device in accordance with the present invention.

Referring to FIG. 1, the exercise device 10 includes an elongated upstanding frame 12 constructed of wood, tubular or flat metal, or other suitable rigid material. Frame 12 comprises two spaced posts 14 having curved upper and lower end portions 16 and 18, respectively, which are welded or otherwise secured to top and bottom mounting plates 20 and 22, respectively. Upper and lower struts 24 and 26 also interconnect posts 14, as does U-shaped brace 28. The frame 12 is attached to a substantially vertical supporting surface 30, such as a wall, by bolts, wood screws, or other suitable fasteners 32 secured to plates 20 and 22. Lower portions 18 of posts 14 may also be secured to the floor by bolts 34. The exercise device may be removed from the vertical supporting structure for storage or repositioning with a minimum of inconvenience when quick-disconnect fasteners are used.

An upper pulley 36 is located at the top of frame 12, bolted to upper strut 20. A lower pulley 38 is located at the bottom of frame 12, bolted to lower strut 26. The pulleys 36, 38 typically are constructed of metal but may be constructed of plastic or other suitable material.

Figure 2:
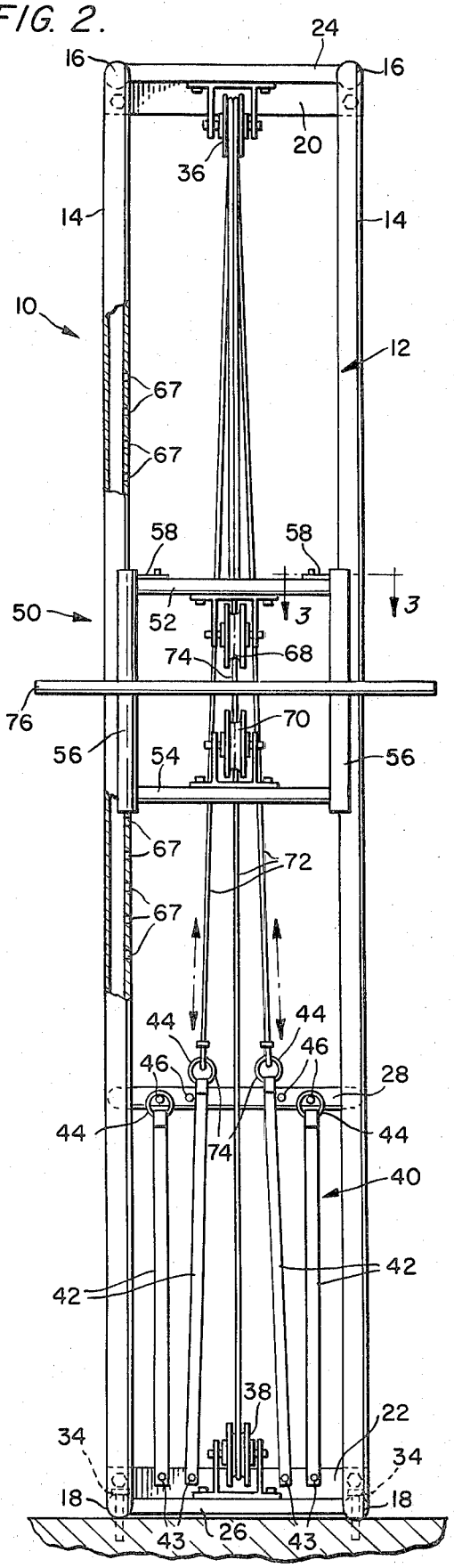
FIG. 2 is a front elevational view thereof.

A resistance load 40 is positioned in the lower portion of frame 12. As illustrated in FIGS. 1 and 2 the resistance load comprises a plurality of elastic straps 42. Coiled springs may be used in lieu of elastic straps. The lower ends of straps 42 are secured to lower plate 22 by rivets 43 or other suitable means. The upper end of straps 42 terminate in rings 44 which are adapted to be retained on pins or hooks 46 secured to brace 28 when the device is not being used.

The exercise device 10 further includes a carriage 50 which is movable up or down along posts 14 and may be locked into position at any selected height. Carriage 50 comprises upper and lower bars 52 and 54 welded or otherwise secured to side channels 56 which embrace posts 14 and guide carriage 50 therealong.

Carriage 50 further includes upper and lower guide pulleys 68 and 70 respectively bolted to upper and lower bars 52 and 54. Guide pulleys 68 and 70 are in fixed relation to one another, but are movable with respect to frame 12 since they are carried within carriage 50.

Both ends of cable 72 are attached to the ring top 44 of one or more elastic straps 42 by a hook and eye 74 or other suitable attachment means. Cable 72 may be a metallic cable, a rope or any other suitable flexible and strong force-transmitting element. Cable 72 is trained up and over upper pulley 36 in a counterclockwise direction as seen in FIG. 1, down and under lower pulley 36 in a clockwise direction as seen in FIG. 1, between guide pulleys 68 and 70, up and again over upper pulley 36 in a clockwise direction, and then down to strap 42. A working loop 75 is formed by the intermediate portion of cable 72 which projects laterally from the device 10 between guide pulleys 68 and 70. Grip bar or handle 76 is attached to working loop 75 by hook 76 or other suitable engaging means. The length of working loop 75 remains constant (when handle 76 is not pulled) at every height adjustment of carriage 50. This results from the manner of threading cable 72 about the pulleys in a continuous loop whose length is constant.

Figure 3:
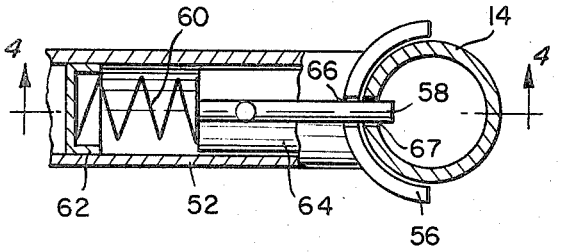
FIG. 3 is a cross-sectional view of the height adjustment mechanism of the device taken along line 3—3 of FIG. 2.
Figure 4:
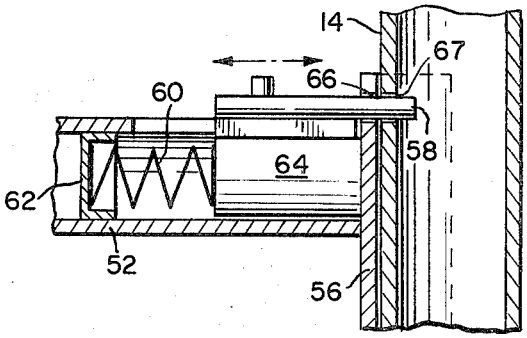
FIG. 4 is a cross-sectional view of the same taken along line 4—4 of FIG. 3.
Figure 5:
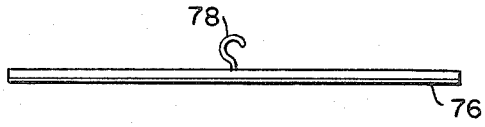
FIG. 5 shows a grip bar and engagement hook in accordance with the present invention.

In operation the height of handle 76 is readily adjustable (see FIGS. 3, 4) by releasing latch pins 58 from apertures 67 in posts 14, vertically sliding carriage to the desired height, aligning latch pins 58 with apertures 67 at this desired height, and releasing latch pins 58 so that they are seated in apertures 67 by latch springs 60. A wide variety of exercises may be performed on the exercise device 10 because the height of the handle 76 is adjustable. In addition, the exercise device 10 is readily adaptable for use by persons of different heights.

Adjustment of the resistance load is also readily accomplished regardless of the type of resistance used. When elastic straps, springs, or the like are used, the magnitude of the resistance is determined by the number of straps 42 which are connected to hooks 74 at the ends of cable 72. This method of attachment facilitates easy removal and replacement of resistance elements. The number of resistance elements may be increased or decreased to meet the needs of a specific person or exercise. In addition, resistance elements of varying resistance may by readily substituted for one another.

Figure 6:
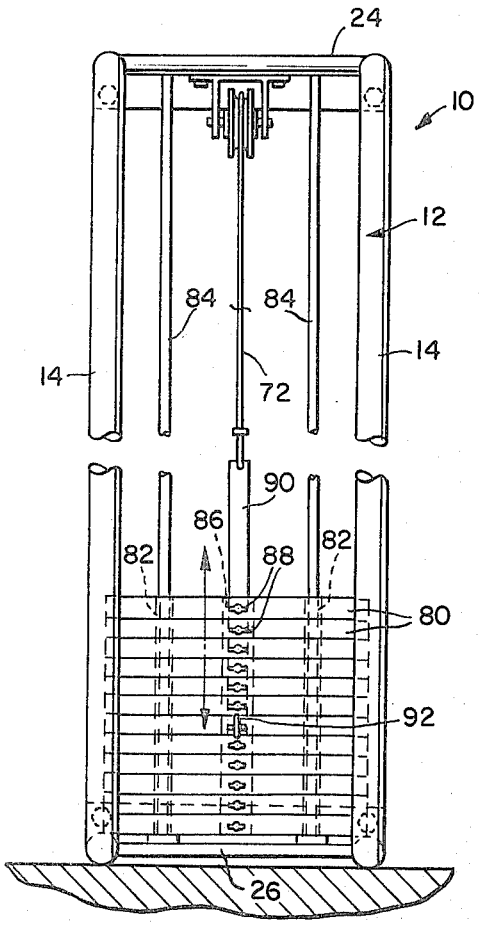
FIG. 6 is a front elevational view of a wall mounted adjustable exercise device employing a plurality of selectively engaged weights in accordance with the present invention.
Figure 7:
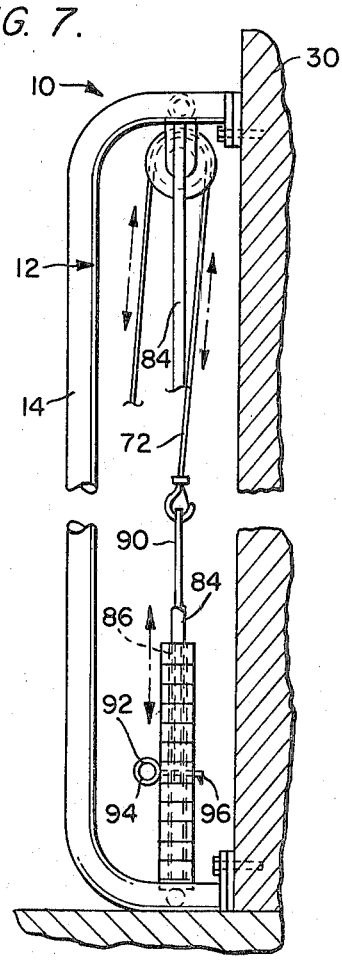
FIG. 7 is a side elevation of the apparatus of FIG. 6.

In the alternative embodiment illustrated in FIGS. 6 and 7, the resistance elements comprise a plurality of stacked weights 80. The weights may be rectangular solid cast iron weights. As illustrated in FIG. 6, each of the weights 80 includes a pair of spaced vertical guide bores 82 which are penetrated by guide bars 84. Guide bars 84 are securely attached to the upper and lower struts 24, 26 of frame 12. Guide bars 82 may be constructed of metal tubing, metal rods, or other suitable material. Weights 80 are free to move along guide bars 84.

A central lifting bore 86, penetrates weights 80. Each individual weight 80 carries a key bore 88, which horizontally penetrates each weight 80 from front to back, and penetrates lifting bore 86. A lifting bar 90 is inserted into lifting bore 86. Lifting bar 90 includes a plurality of horizontal apertures (not shown) drilled along parallel spaced axes having the same spacing as the key bores 88 in weights 80. The top end of lifting bar 90 is attached to both ends of cable 72, as described above. The horizontal bores in lifting bar 90 are aligned with key bores 88 in weights 80. Key 92 may be inserted into any desired key bore 88 through a mating horizontal bore in lifting bar 90. Key 92 may include a ringed head 94 into which a finger can be inserted, a shaft, and a key flange 96. Key bores 88 and horizontal bores in lifting bar 90 conform roughly to the shape of key 92, which may be inserted therethrough when properly aligned. After insertion, key 92 is rotated, thereby locking the key in place.

In operation, the keying system permits the user to readily change the number of weights 80 to be lifted, since the weight through which the key is inserted and all weights 80 above the key will be lifted.

Figure 8:
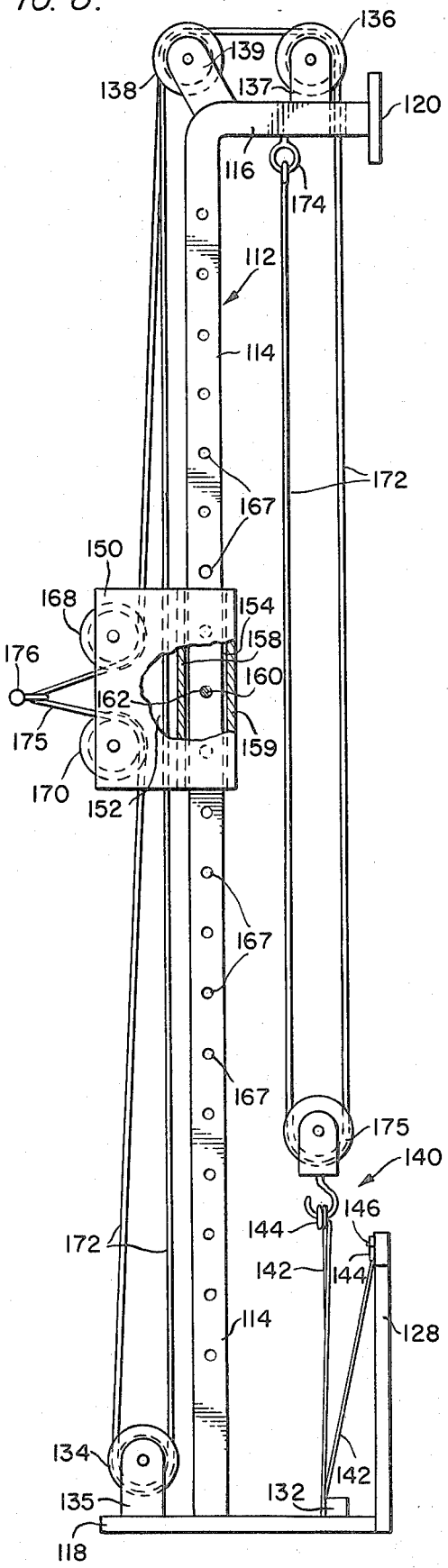
Figure 9:
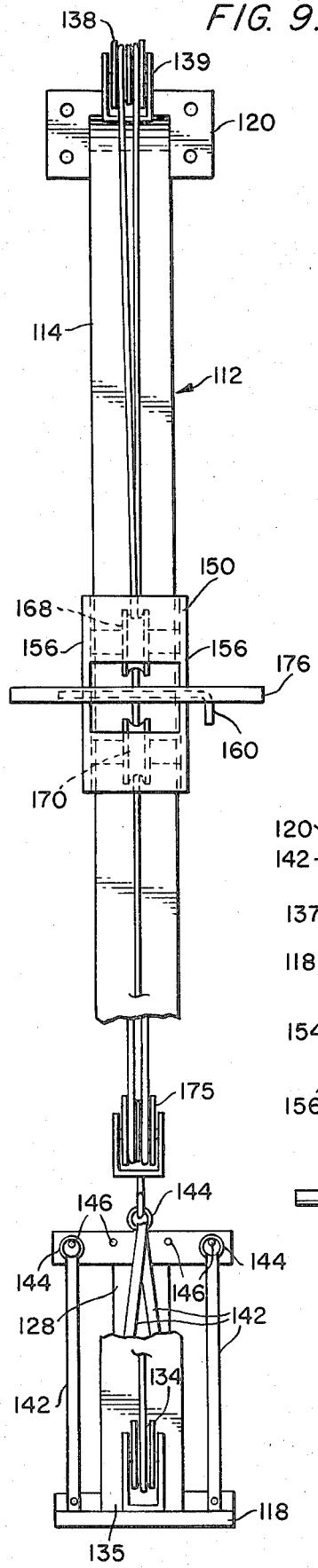
Figure 10:
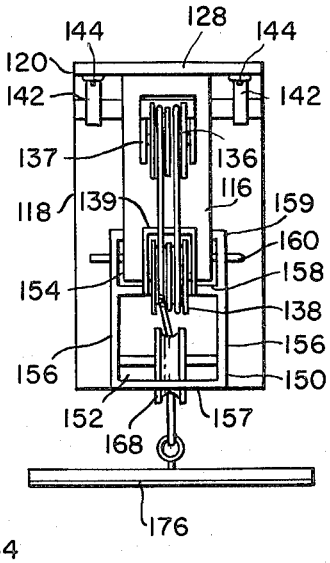

FIGS. 8, 9 and 10 illustrate an alternative embodiment of the invention. In this embodiment the exercise device includes an elongated upstanding frame 112 constructed of metal or other suitable rigid material. Frame 112 has a hollow, generally rectangular cross section, and comprises an upright post 114 having a curved upper portion 116. The lower end of post 114 is welded or otherwise secured to a floor engaging base 118. Upper portion 116 is welded or otherwise secured to a wall engaging bracket 120.

Two double sheave upper pulleys 136, 138 are respectively journaled in brackets 137, 139 affixed to upper portion 116. A lower, single sheave pulley 134 is journaled in a bracket 134 affixed to base 118. A resistance load 140 in the form of elastic straps 142 are attached at their lower ends to a mounting block 132 secured to base 118. The upper ends of straps 142 are provided with rings 144 which are adapted to engage pins or hooks 146 secured to a T-brace 128 when not in use. Elastic straps 142 may be replaced by springs, vertically guided weights or other equivalent resistance loads.

A carriage 150 is provided which is movable up or down along post 114 and may be locked into position at any selected height. Carriage 150 comprises a double tubular member having a front hollow portion 152 and rear hollow portion 154 defined by side members 156, front member 157, center member 158 and rear member 159.

Carriage 150 further includes upper and lower guide pulleys 158 and 170, respectively, journaled between side members 156. Guide pulleys 168 and 170 are in fixed relation to one another, but are movable with respect to frame 112 since they are carried within carriage 150. Carriage 150 may be secured at a particular location along post 114 by inserting a lock pin 160 through aligned holes 162 in side members 156 and a selected pair of holes 187 in the sides of post 114.

Both ends of a cable 172 are attached to a ring 174 secured to upper portion 116. Cable 172 is trained around a movable pulley 175, which is connected to any selected number of elastic straps 142 through rings 144. Cable 172 is then trained up and over pulleys 136 and 138. One leg of cable 172 then passes straight down through hollow 152 of carriage 150, around pulley 134 and around guide pulley 170. The other leg of cable 172 is trained around guide pulley 168. A working loop 175 is formed by the intermediate portion of cable 172 which projects laterally from the exercise device between guide pulleys 168 and 170. Grip bar or handle 176 is attached to working loop 175 by a hook or other suitable sliding engaging means. The length of working loop 175 remains constant at every height adjustment of carrige 150.

While the preferred embodiments of the invention have been illustrated and described, it is to be understood that these are capable of variation and modification by those skilled in the art and that the scope of the invention is not limited to the precise details set forth, but should determined by the following claims.

I claim:

1. An exercise device comprising:

an upstanding elongated fame;

resistance means operatively connected to said frame for providing an exercising force in response to exercising motions of a user;

an upper pulley attached to the upper portion of said frame;

a lower pulley attached to the lower portion of said frame;

a two-ended cable trained around said upper and lower pulleys and operatively connected to said resistance means;

grip means slidably attached to an intermediate portion of said cable for engagement by a user to apply pulling exercising motions to said resistance means through said cable; and guide means carried by said frame and selectively positionable at various heights relative to said frame, for guiding said intermediate portion of said cable laterally outwardlly of said frame so that the length of said outwardly projecting intermediate cable portion, when not pulled, is substantially constant irrespective of the height of said guide means.

2. An exercise device according to claim 1 wherein said guide means comprises a carriage and a pair of vertically spaced guide pulleys journalled in said carriage, said intermediate cable portion being trained around and between said guide pulleys.

3. An exercise device according to claim 2 wherein said frame comprises two upright, spaced, parallel posts, and said carriage includes post engaging means at each side thereof for guiding said carriage along said posts and selectively fixing said carriage to said posts at various heights.

4. An exercise device according to claim 3 wherein said posts include a plurality of longitudinally spaced holes facing said carriage, and each of said post engaging means includes a retractable pin receivable in a selected one of said holes.

5. An exercise device according to claim 4 wherein said pin is spring-biased toward its adjacent post into locking engagement with said selected hole.

6. An exercise device according to claim 2 wherein said frame comprises a guide post and said carriage comprises a portion surrounding and slidable along said guide post.

7. An exercise device according to claim 1 wherein said frame comprises a guide post and said guide means comprises a portion surrounding and slidable along said guide post.

8. An exercise device according to claim 1 wherein said resistance means comprises at least one elongated elastic element, one end of said element is attached to said frame and the other end of said element is attached to both ends of said cable; one portion of said cable extends from said intermediate cable portion through said guide means, around one pulley and to said element, and the remaining portion of said cable extends from said guide means, around the other pulley, around said one pulley and to said element.

9. An exercise device according to claim 8 wherein said resistance means comprises a plurality of elastic elements each attached at one end to said frame, and the magnitude of the resistance force is adjustable as a function of the number of said elements which are attached to the ends of said cable.

10. An exercise device according to claim 1 wherein said resistance means comprises at least one weight connected to both ends of said cable, one portion of said cable extends from said intermediate cable portion through said guide means, around one pulley and to said weight, and the remaining portion of said cable extends from said guide means, around the other pulley, around said one pulley and to said weight.

11. An exercise device according to claim 10 wherein said resistance means comprises a stack of weights and means for selectively connecting a selected number of said weights to the ends of said cable.

12. An exercise device according to claim 11 wherein said resistance means further comprises weight guide means for guiding the movement of said selected weights during exercise.

13. An exercising device comprising:

an upstanding elongated frame including two upright spaced, parallel posts;

resistance means operatively connected to said frame for providing an exercising force in response to exercising motions of a user;

an upper pulley attached to the upper portion of said frame;

a lower pulley attached to the lower portion of said frame;

a two-ended cable trained around said upper and lower pulleys with its ends connected to said resistance means;

grip means slidably attached to an intermediate portion of said cable for engagement by a user to apply a pulling exercising motion to said resistance means through said cable; and guide means including a carriage and a pair of vertically spaced guide pulleys journalled in said carriage, and said carriage includes post engaging means at each side thereof for guiding said carriage along said posts and selectively fixing said carriage to said posts at various heights, said intermediate cable portion being trained around and between said guide pulleys for guiding said intermediate portion of said cable laterally outwardly of said frame so that the length of said outwardly projecting intermediate cable portion, when not pulled, is substantially constant irrespective of the height of said guide means.

14. An exercise device according to claim 13 wherein said resistance means comprises at least one elongated elastic element, one end of said element is attached to said frame and the other end of said element is attached to both ends of said cable; one portion of said cable extends from said intermediate cable portion through said guide means, around one pulley and to said element, and the remaining portion of said cable extends from said guide means, around the other pulley, around said one pully and to said element.

15. An exercise device according to claim 14 wherein said resistance means comprises a plurality of elastic elements each attached at one end to said frame, and the magnitude of the resistance force is adjustable as a function of the number of said elements which are attached to the ends of said cable.

16. An exercise device according to claim 13 wherein said resistance means comprises at least one weight connected to both ends of said cable, one portion of said cable extends from said intermediate cable portion through said guide means, around one pulley and to said weight, and the remaining portion of said cable extends from said guide means, around the other pulley, around said one pulley and to said weight.

17. An exercise device according to claim 16 wherein said resistance means comprises a stack of weights and means for selectively connecting a selected number of said weights.

18. An exercise device according to claim 17 wherein said resistance means further comprises weight guide means for guiding the movement of said selected weights during exercise.

* * * * *